United States Patent [19]

Woody

[11] Patent Number: 4,813,745

[45] Date of Patent: Mar. 21, 1989

[54] RESTRAINING DEVICE

[76] Inventor: Van D. Woody, R.R. 1 414A, Suncook, N.H. 03275

[21] Appl. No.: 107,103

[22] Filed: Oct. 13, 1987

[51] Int. Cl.[4] ..... A47C 31/00; E05B 75/00

[52] U.S. Cl. ..... 297/464; 70/16; 297/183; 297/191; 297/217

[58] Field of Search ..... 297/464, 466, 469, 183, 297/191, 217; 128/133, 134; 70/16, 18

[56] References Cited

U.S. PATENT DOCUMENTS

| | | | |
|---|---|---|---|
| 2,675,060 | 4/1954 | Strand | 297/183 X |
| 2,847,174 | 8/1958 | Sribny | 297/191 X |
| 3,007,331 | 11/1961 | Irwin | 70/16 X |
| 3,545,237 | 12/1970 | Thompson et al. | 70/16 |
| 4,173,974 | 11/1979 | Belliveau | 70/16 X |

FOREIGN PATENT DOCUMENTS

| | | | |
|---|---|---|---|
| 639715 | 4/1928 | France | 297/466 |

*Primary Examiner*—James T. McCall

*Attorney, Agent, or Firm*—H. Jay Spiegel & Associates

[57] ABSTRACT

Disclosed is an improved restraining device which restrains a prisoner in a seated position with the hands and arms clamped in a position restraining the prisoner. The device may include back and head support structure as well as a seating area and a pair of pedestals each of which is designed to restrain one of the arms. Mechanically or electromagnetically activated clamps are associated with the pedestals and are provided to releasably clamp the wrists and hands of the prisoner.

7 Claims, 2 Drawing Sheets

Fig. 1
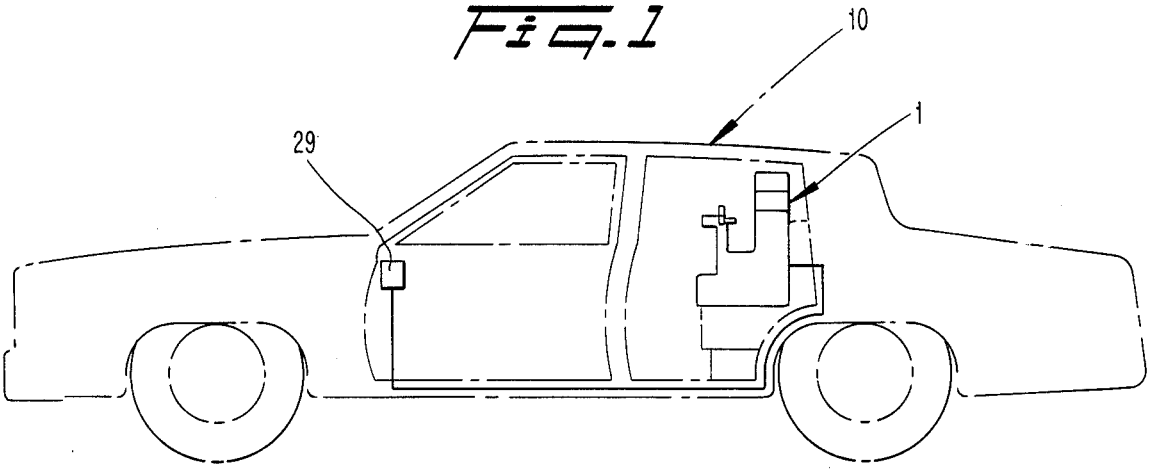
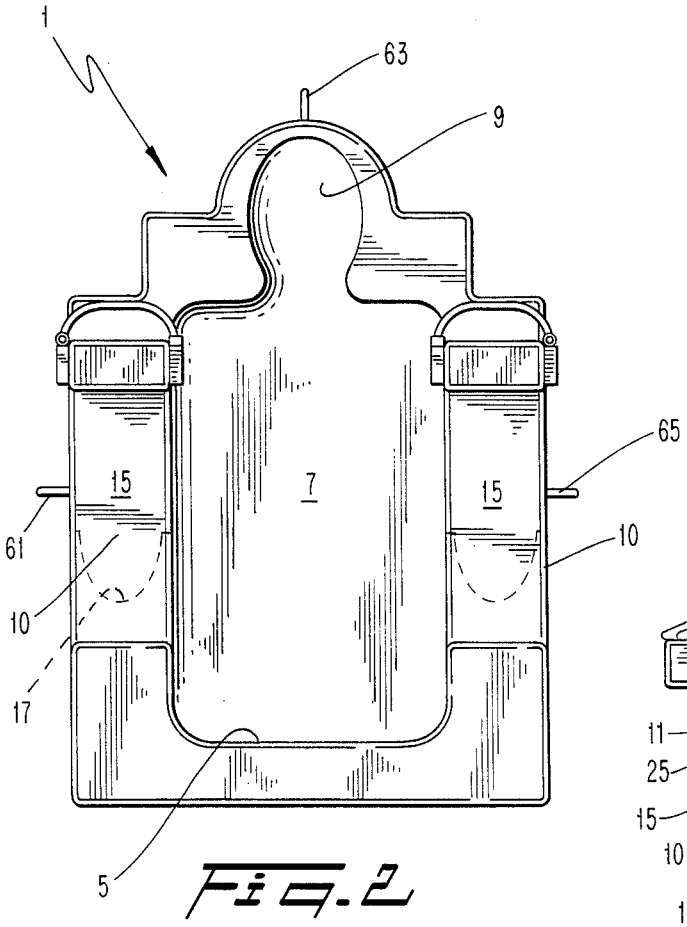
Fig. 2
Fig. 3
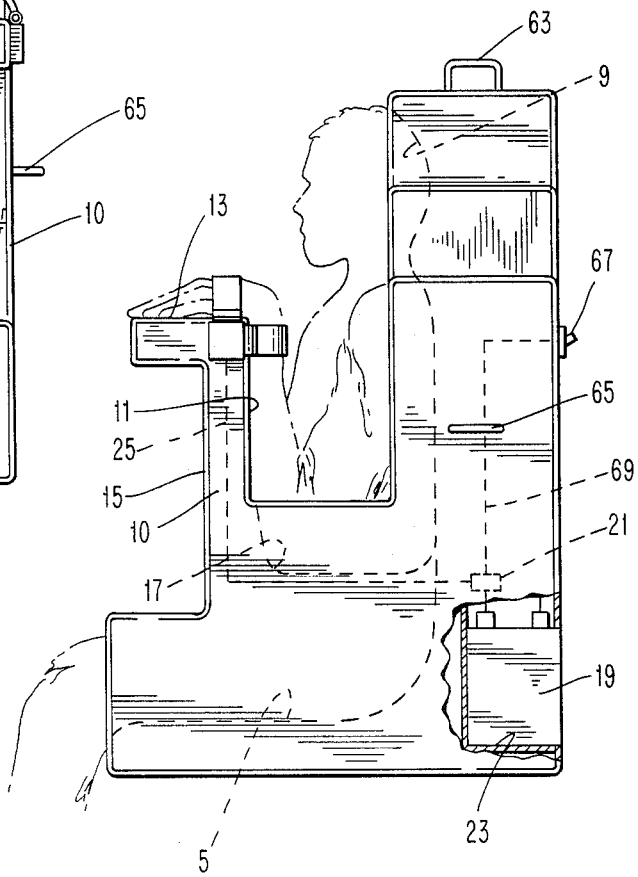

Fig. 4
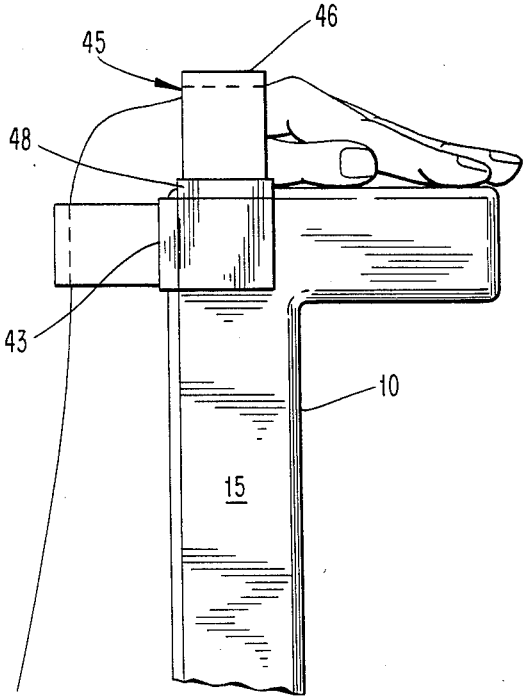
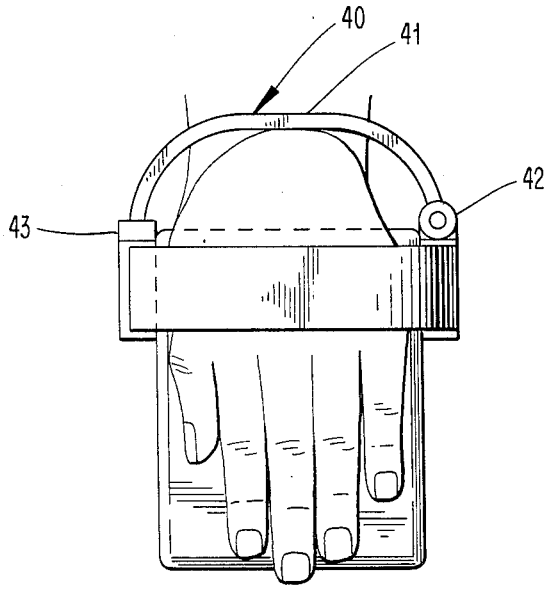
Fig. 5
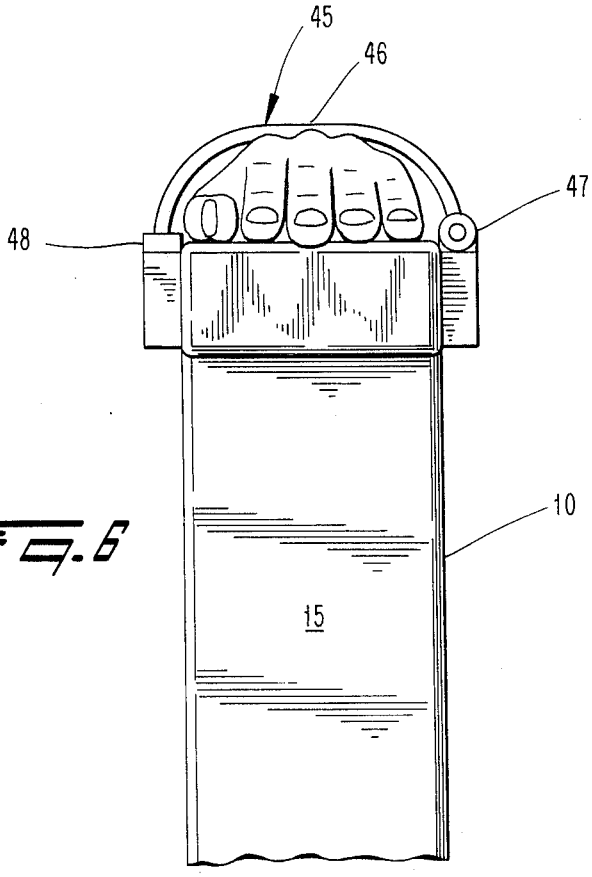
Fig. 6

RESTRAINING DEVICE

BACKGROUND OF THE INVENTION

The present invention relates to an improved restraining device. In the prior art, it is well known to provide restraints for prisoners, however applicant is aware of no prior art which restrains a prisoner in the manner disclosed hereinafter. Applicant is aware of the following prior art:

U.S. Pat. No. 1,082,229 to Nagle discloses a gyve lock comprising a prisoner restraint device specifically designed to restrain a prisoners arms and legs in a predetermined standing position. This patent is believed to be only generally related to the teachings of the present invention since the present invention includes back and head support structure and restrains the prisoner in a seated position.

U.S. Pat. No. 1,410,802 to Foster discloses a handcuff device designed to attach to both the wrists and the neck of the prisoner to restrain the hands and arms in an upwardly facing orientation. While the present invention is intended to restrain the arms and hands of the prisoner in a similar orientation to that which is disclosed in Foster, Foster fails to disclose the back and head support structure as well as the specific clamping means disclosed herein.

U.S. Pat. No. 4,173,974 to Belliveau discloses a restraining means designed to be mounted within a vehicle and including an upwardly extending post to which hand and ankle restraints may be releasably fastened. The present invention is clearly distinct from the teachings of Belliveau since the present invention contemplates back and head support structure as well as releasable restraining means for restraining the arms and hands in a vertically oriented position.

Accordingly, a need has developed for an improved restraining device which will restrain the prisoner in a seated position with the arms in a submissive orientation.

SUMMARY OF THE INVENTION

The present invention overcomes the deficiencies found in prior art designs and provides a new and improved restraining device including the following interrelated aspects and features:

(a) In a first aspect of the present invention, the inventive restraining device includes a body support housing including a seating portion sized and configured to be seated upon by the prisoner, a back supporting portion designed to support the back of the prisoner and a headrest portion integrally formed in the housing and designed to comfortably support the rear of the head of the prisoner.

(b) To either side of the seat supporting portion of the housing, an upstanding column is provided with each such column having a top surface designed to support the palms of the hands of the prisoner while each forearm of the prisoner engages a rear surface of a respective column.

(c) At the top of the rear surface of each column, a wrist restraint is provided which may be of a mechanical or electromagnetic actuated structure. Adjacent the wrist restraint and mounted in pivotable overlying relation to the top surface of each column is a hand restraint which may also be of either an electromagnetic or mechanical actuated structure.

(d) If the above described restraints are electromagnetically activated, the body support housing may include a cavity therein containing all of the electronics necessary to control the restraints and, if desired, the restraints may be controlled through remote control activation either by wireless transmitter or through electrical conductors connected to the control structure in the housing and to remote control switching devices. If desired, the improved restraining device may be either permanently connected into a vehicle or may be detachably connected therein. If the device is to be detachably connected therein, handles are provided so that the prisoner may easily transported while locked therein.

Accordingly, it is a first object of the present invention to provide an improved restraining device.

It is a further object of the present invention to provide an improved restraining device including a body support housing designed to comfortably support the seat back and head of a prisoner.

It is a still further object of the present invention to provide such a device including wrist and hand restraints to restrain the prisoner in a prescribed position.

It is a still further object of the present invention to provide such an improved restraining device with either mechanical or electromagnetic actuation of wrist and hand restraints thereof.

It is a yet further object of the present invention to provide such a device which may be either permanently installed in a vehicle or may be detachably secured therein.

These and other objects, aspects and features of the present invention will be better understood from the following detailed description of the preferred embodiment when read in conjunction with the appended drawing figures.

BRIEF DESCRIPTION OF THE DRAWINGS

FIG. 1 shows a side schematic view of the present invention as a vehicle.

FIG. 2 shows a front view of the invention with a prisoner contained therein.

FIG. 3 shows a side view of the invention.

FIG. 4 shows a detailed view of one of the columns of the present with a wrist restraint and hand restraint.

FIG. 5 shows a top view of the view of FIG. 4; and FIG. 6 shows a front view of the FIG. 4 and FIG. 5 showings.

SPECIFIC DESCRIPTION OF THE PREFERRED EMBODIMENT

With reference first to FIGS. 1–3, it is seen that the inventive restraining device 1 includes a body support housing 3 having a seat rest 5, a back rest 7 and head rest 9. If desired, the inventive housing 3 may be molded out of a single piece of plastic or carved out of a single piece of wood so that the desired rest portions 5, 7 and 9 are included. Alternatively, the inventive housing 3 may be assembled in any desired manner.

With reference to FIGS. 2 and 3 in particular, it is seen that the inventive housing 3 has mounted thereon two upwardly extending columns 10 each of which includes a back surface 11 and a top surface 13 as well as a front surface 15. At the bottom of the back surface 11, an elbow guard 17 is provided to securely place the elbow in position on the surface 11 of the column 10.

As seen in FIG. 3, if the restraints, to be described in greater detail hereinafter, are to be activated through the use of electromagnetic force, a battery 19 and electrical control box 21 may be provided and mounted in a cavity 23 formed in the housing 3. If such is the case, wires 25 will extend from the control box 21 to the individual restraints so that they may be controllably activated with other wires 27 also emanating from the control box to a control station 29 seen, for example, in FIG. 1.

If the restraints are to be activated through the use of electromagnetic energy, the electrical control box 21 merely consists of a plurality of switches with each switch having an open position allowing no current to flow therethrough and a closed position allowing the current to flow from the battery to an electromagnetic coil (not shown) in a particular restraint to allow the electromagnetic energy to maintain the restraint in a restraining position. In such case, the wires 27 merely comprise control wires controlling the position of a particular switch within the electrical control box 21. The switches in the electrical control box 21 may be actuated in any known way and the particular mode of actuation thereof does not form a part of the present invention.

With reference now to FIGS. 4–6, one of the columns 10 is depicted and is seen to have attached thereto a wrist restraint 40 and a hand restraint 45. As seen in FIG. 5, the wrist restraint 40 includes a pivoting U-shaped member 41 pivotable about a pivot pin 42 and including a clasp (not shown) releasably engaged in a keeper 43. The keeper 43 may be operative to release the restraint 41 either through a release of electromagnetic force or through mechanical means such as a key lock. It should be stressed that electromagnetic force where used may be utilized either to keep the keeper in the locked position or to open the keeper to allow movement of the restraint 41.

With further reference to FIG. 6, it is seen that the hand restraint 45 includes a restraint 46 pivoted about a pivot pin 47 and releasably retained within a keeper 48. The operation of the elements 46 and 48 corresponds to the operation of respective elements 41 and 43.

With reference to FIG. 1, again, the control panel 29 may include four activating devices each of which activates one of the four restraints 40, 40, 45, 45 when the restraints are activated and deactivated through the use of electromagnetic energy.

As further seen in FIG. 1, the device 1 may be releasably or permanently mounted within a vehicle. If the device 1 is to be detachably secured to a vehicle, as seen in FIG. 2, handles 61, 63 and 65 may be provided. The operation of the present invention should be self-explanatory in light of the above description. When it is desired to restrain a prisoner, the prisoner is seated within the body support housing 3 as shown in FIGS. 1–3 and the restraints 40, 40, 45, 45 are clamped about the wrist and hand of the prisoner to restrain the prisoner in place in the housing 3 in the orientation shown in FIGS. 1–3. If the device 1 is removably contained within a vehicle, through the use of the handles 61, 63 and 65, the prisoner may be lifted out of the vehicle 10 and carried to a desired destination as desired.

When the device includes electromagnetic actuation of the restraints, a separate power supply may be provided in the vehicle with plug in connection to the housing 3 with such plug in connection being utilized, in the preferred embodiment, whether or not the device is detachably connected or permanently connected to the vehicle. As seen in FIG. 3, an emergency switch 67 may be provided which connects to the electrical control box 21 via wire 69. The switch 67 may be provided so that in case of an emergency, activation of the switch 67 will release all restraints 40, 40, 45, 45 simultaneously so that the prisoner may easily be removed from the vehicle.

When the device is made of molded plastic, as is preferred, it constitutes an extremely lightweight easily transportable prisoner restraint.

Accordingly, the present invention has been disclosed in terms of a preferred embodiment thereof. Of course, various changes, modifications and alterations in the teachings of the present invention may be contemplated by those skilled in the art without departing from the intended spirit and scope thereof. Accordingly, it is intended that the present invention only be limited by the terms of the appended claims.

I claim:

1. An improved restraining device comprising (a) a housing having a seating portion sized to receive the buttocks of a person;

(b) said housing further including, to each side of said seating portion, an upstanding column; and (c) restraining means including at least one restraint mounted on each said column for restraining the wrists and hands of said person, said restraining means including at least one electrically actuable restraint, and power supply means mounted in said housing for controllably supplying power to said at least one electrically actuable restraint.

2. The invention of claim 1, wherein said housing further includes a back supporting portion and a head rest.

3. The invention of claim 1, wherein each said restraint comprises:

(a) a wrist restraint; and (b) a separate hand restraint.

4. The invention of claim 3, wherein said wrist restraint comprises an electromagnetically activated pivoted locking cuff.

5. The invention of claim 4, wherein said separate hand restraint comprises a further electromagnetically activated pivoted locking cuff.

6. The invention of claim 4, further wherein said power supply means comprises a battery mounted in said housing.

7. The invention of claim 1, further including handle means attached to said housing for grasping to enable transport of said device.

* * * * *